United States Patent [19]

David

[11] 4,050,099

[45] Sept. 27, 1977

[54] SHOULDER PROTECTOR

[76] Inventor: Nel E. David, 1342 SW. 17th St., Miami, Fla. 33145

[21] Appl. No.: 649,536

[22] Filed: Jan. 15, 1976

[51] Int. Cl.[2] ..... A41B 13/10

[52] U.S. Cl. ..... 2/46; 2/49 R

[58] Field of Search ..... 2/49 R, 46

[56] References Cited

U.S. PATENT DOCUMENTS

| | | | |
|---|---|---|---|
| 1,201,701 | 10/1916 | Crane | 2/49 R X |
| 2,482,182 | 9/1949 | Henninger | 2/49 R |
| 2,617,105 | 11/1952 | Backman | 2/49 R |
| 2,727,239 | 12/1955 | Simon | 2/49 R |
| 2,793,367 | 5/1957 | Hart | 2/49 R |
| 2,831,193 | 4/1958 | Terry | 2/46 |
| 2,955,293 | 10/1960 | Peterson | 2/49 R |

*Primary Examiner*—Alfred R. Guest

*Attorney, Agent, or Firm*—Clarence A. O'Brien; Harvey B. Jacobson

[57] ABSTRACT

A protective shoulder cover which is positively held on a person's shoulder by means of tie straps or Velcro snap portions. The cover in one embodiment has an absorbent material outer layer, a liquid impervious inner layer, and interlining between these two layers at the shoulder for the purpose of providing padding. The shoulder portion is also form-fitting to provide a secure fit on a person wearing same. Several other embodiments are envisioned by this invention; the interlining may be omitted between the two layers, and both layers may be made of absorbent material.

7 Claims, 4 Drawing Figures

Fig. 1
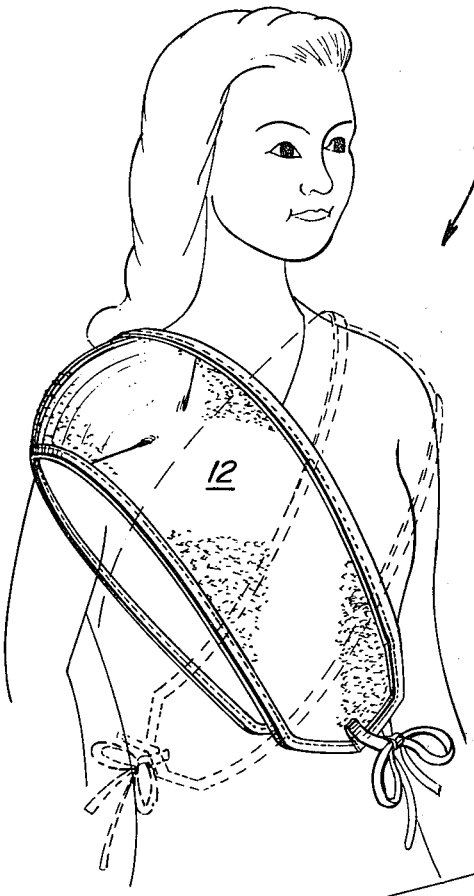
Fig. 2
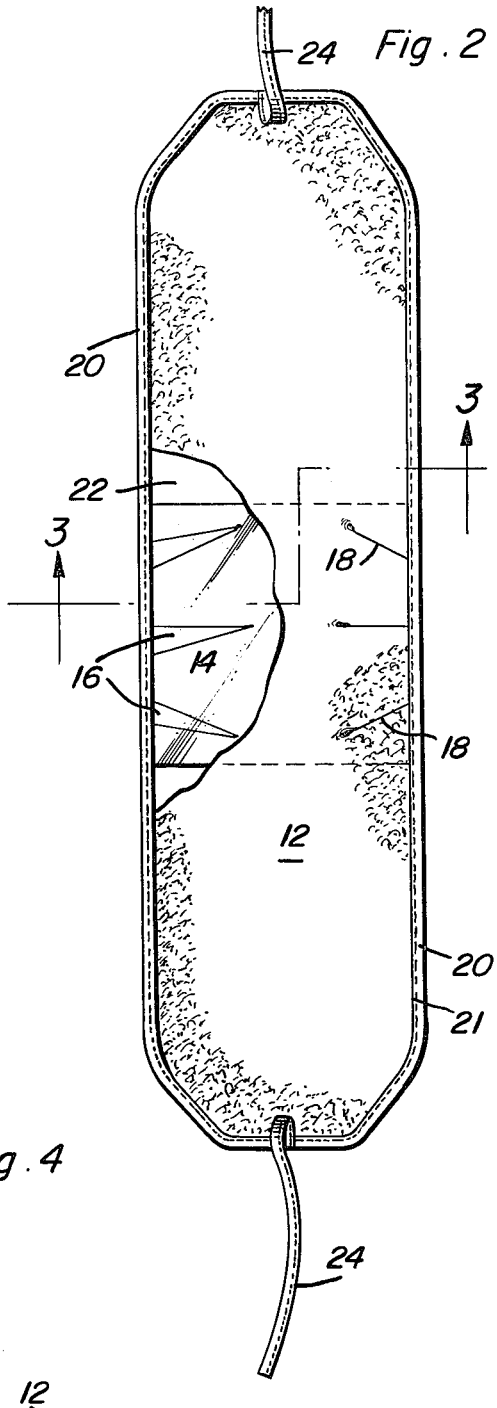
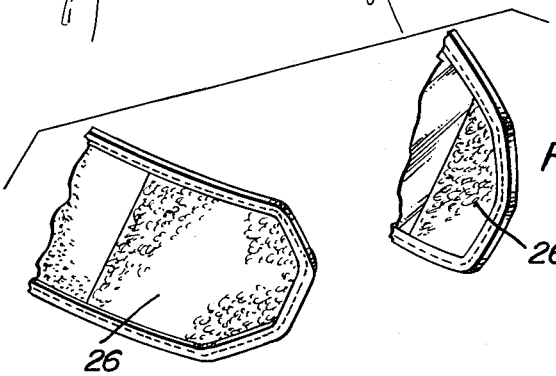
Fig. 4
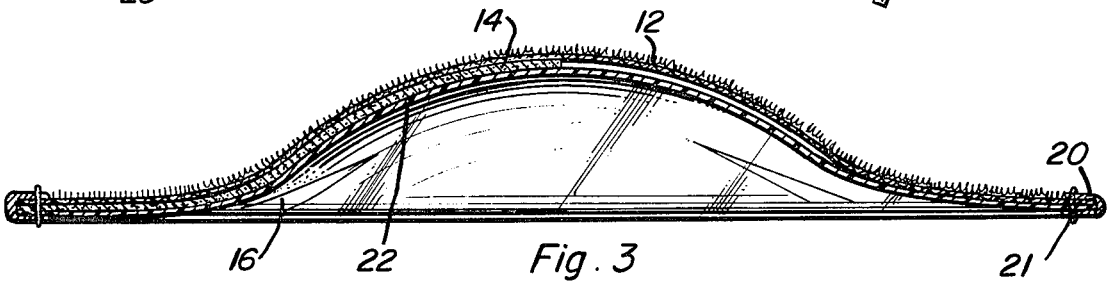
Fig. 3

SHOULDER PROTECTOR

BACKGROUND OF THE INVENTION

1. Field of the Invention

This invention relates generally to protective coverings for wearing by a person using the covering. Means are provided for securely holding said cover to the wearer.

2. Description of the Prior Art

A common problem with known bibs, aprons, etc., are that many of them are general purpose and not really form-fitting and therefore fail to give the amount of protection desired by a person wearing same.

Another common problem is that many of the known prior art devices are either overly bulky and unduly burden the wearer, or else they are not bulky enough and fail to give the amount of protection a wearer needs. Known prior art patents which may be pertinent to this invention are listed as follows:

| | | |
|---|---|---|
| B. D. Sossamon | 2,499,689 | Mar. 7, 1950 |
| L. M. Simon | 2,727,239 | Dec. 20, 1955 |
| B. M. Hart | 2,793,367 | May 28, 1957 |
| L. C. Peterson | 2,955,293-2/49 | Oct. 11, 1960 |

SUMMARY OF THE INVENTION

An object of the present invention is to provide a protective garment which snugly fits the shoulder of a wearer to prevent soiling of the clothes of the wearer.

Another object of the present invention is to provide a shoulder fitting protective garment which is impervious to liquid on the inner surface thereof and which is liquid absorbent on the outer surface thereof.

A further object of this invention is to provide a protective shoulder bib having an additional padded layer as part of the garment at the portion of the garment which fits the shoulder. This additional padding provides additional protection and increased comfort for the wearer but since it is only provided where needed does not add any additional bulk to the over-all garment.

A still further object of the present invention is to provide a protective garment which has positive securing means such as tie straps or Velcro covered overlapping ends to positively retain the garment on a person wearing same.

Another further object of this invention is to provide liquid absorbent material on both surfaces of the garment and to replace the section of padding with a waterproof portion between the two layers. Also the absorbent material may be of paper so the bib can be thrown away after use thereof.

The protective shoulder garment as envisioned by this invention is form-fitting to a person wearing same on either shoulder, is interchangeable with either shoulder, and offers additional padding material at the shoulder portion only to give increased protection without adding undue bulk. Positive retaining means such as straps or Velcro fasteners are provided so that the garment, in addition to being form-fitting, will also be securely and positively retained on a person wearing same. Nevertheless the garment will still be easily removed when a person desires to do so.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the shoulder protector of this invention as applied to a shoulder of a user.

FIG. 2 is a top plan view, partly broken away at the center portion thereof, of the protector of this invention.

FIG. 3 is a cross-sectional view taken generally along line 3—3 of FIG. 2.

FIG. 4 is a perspective view, in part, of the ends of the protector with a modified type of fastening structure.

DESCRIPTION OF THE PREFERRED EMBODIMENT

Referring now more particularly to the drawing, a shoulder protector according to the present invention is shown being worn by a person designated in general by reference numeral 10 in FIG. 1. The protective garment is made up of layers, as best seen in FIG. 2, comprising an absorbent layer 12 made of material such as terry cloth and a liquid-impervious layer 22 made of material such as plastic. These two layers are fastened together along their outer edges 20 by means of stitching 21 or other suitable fastening means. A third layer portion 14 is provided at the center of the bib as seen in FIG. 2 for the purpose of providing additional padding along the portion of the garment which fits and covers the shoulder of a wearer. This inner lining or additional padding would preferably be of sufficient length to extend approximately six inches or so down from each side of a person's shoulder when the garment is being worn. Any suitable cloth or padding type material, etc., may be used for this inner layer.

Another embodiment of this invention is to make both layers 12 and 22 of absorbent material, and omit the padding 14, or replace the padding with a similar length section of plastic or other liquid-impervious material. Also, instead of using terry cloth for the absorbent layers, an absorbent paper may be used so the bib can be disposed of after use rather than cleaning same.

Appropriate darts 18 and inner stitching 16, as seen in FIGS. 2 and 3, are also provided along the middle portion of the protector so that the garment will be relatively form-fitting to a person's shoulder.

Means are provided to secure this garment to the shoulder of a wearer in a positive manner. Such means, in FIG. 2, consist of straps 24 which may be appropriately tied at the waist point of the wearer as best seen in FIG. 1. The garment is form-fitting and will fit either shoulder and can be worn on a person's right shoulder as shown in solid lines in FIG. 1 or on a person's left shoulder as indicated by dotted lines in the same figure.

FIG. 4 shows a modification of this invention wherein Velcro portions 26 are applied to the inner and outer ends of the garment to function as the fastening means instead of straps 24. Snaps could also be provided and used instead of either the ties or the velcro, but snaps do not offer the degree of adjustment that the preferred straps or Velcro type fastener provide.

Another feature of the Velcro type fastening means is in the providing of these strips on both sides of each of the ends. With this arrangement a wearer of the protective garment may easily fasten the ends regardless of which shoulder the garment is being worn, and regardless of whether the person is right or left handed. As is well known, it is more difficult for a left-handed person to fasten a garment designed for a right-handed person, and vice versa. Therefore, with the Velcro portions 26 being provided on both sides of each end, this problem is eliminated. Also, the problem is solved no matter which shoulder the garment is being applied to.

Thus it can be seen from the above description that the protective garment as envisioned in this invention has a liquid protecting surface, additional padding for giving utmost protection to the shoulder of a user, and then a final layer of absorbent covering material to complete the garment. With positive means being provided for securing the garment positively and firmly and yet easily removably on the shoulder of a wearer.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A protective garment for the shoulder of a wearer comprising; a first liquid impervious layer, a second padded layer, and a third liquid absorbing layer, each of said layers being secured to the others by fastening means along at least some of the outside edges of said layers, means for positively securing said garment on a person wearing same, the first and third layers are of long substantially rectangular shaped pieces with stitching completely along the outside edges thereof to firmly fasten said layers together, and the second padded layer being much shorter than the first and third layers and being secured in place at the mid-portion only and between said first and third layers by the same stitching that secures them together.

2. The structure set forth in claim 1, wherein at least two darts and tucks are appropriately formed in the padding layer and the third layer at the shoulder fitting portion of the garment to enable said garment to be formfitting.

3. The structure set forth in claim 2, wherein the means for positively securing the garment to a person wearing same includes tie members attached at the respective ends of the garment, for appropriately tying the garment about the waist of the wearer.

4. The structure set forth in claim 2, wherein the means for positively securing the garment to a wearer includes Velcro material appropriately attached at at least one end of the garment.

5. The structure set forth in claim 4, wherein the Velcro material is attached on at least one side of each of the ends of the garment.

6. The structure as set forth in claim 4, wherein the Velcro material is attached on both sides of each of the ends of the garment so that the garment may be worn on either shoulder of a wearer and easily secured by the Velcro fastening means by either a left-handed or a right-handed person.

7. A protective garment for either shoulder of a person, said garment consisting only of a liquid absorbing outer layer of long rectangular shape symmetrical about both a longitudinal and a transverse center line, a liquid impervious inner layer of substantially the same long rectangular shape as the outer layer with both layers having long, straight and uninterrupted side edges, continuous stitching along the edges of both layers to secure them together, means provided so that the garment will snugly fit either shoulder of the wearer to prevent the soiling of the clothes of the wearer including three spaced sets of darts and tucks in each side edge of the respective layers with the darts and tucks being disposed adjacent the central portion of each side edge to shorten the side edges and define a central pocket-like area to receive the shoulder of a person, and means for positively securing the garment to a person wearing same on either shoulder, said means for positively securing the garment to a person wearing same on either shoulder including tie members attached at the respective ends of the garment for appropriately tying the ends about the waist of the wearer with the tie ends being diagonally arranged with respect to the shoulder engaged by the garment thereby disposing the garment diagonally of the torso fo the wearer, said tie members being narrow and attached to the center of the end edges by the stitching which secures the layers together.

* * * * *